US005087088A

United States Patent [19]

Milam

[11] Patent Number: 5,087,088

[45] Date of Patent: Feb. 11, 1992

[54] J-HOOK LATCHING DEVICE

[75] Inventor: Malcolm B. Milam, Laurel, Md.

[73] Assignee: The United States of America as represented by the Administrator of the National Aeronautics and Space Administration, Washington, D.C.

[21] Appl. No.: 654,454

[22] Filed: Feb. 13, 1991

[51] Int. Cl.[5] ..... E05C 5/02

[52] U.S. Cl. ..... 292/110; 292/DIG. 39

[58] Field of Search ..... 292/64, 115, 246, 256.75, 292/304, DIG. 14, DIG. 39, 111, 97

[56] References Cited

U.S. PATENT DOCUMENTS

| | | | |
|---|---|---|---|
| 284,899 | 9/1883 | Reynolds | 292/115 |
| 2,134,314 | 10/1938 | O'Donnell | 220/55 |
| 2,955,862 | 10/1960 | Claud-Mantle | 292/246 |
| 3,325,200 | 6/1967 | Fowler | 292/113 |
| 3,831,580 | 8/1974 | McLean | 126/197 |
| 4,050,725 | 9/1977 | Wilson et al. | 292/304 |
| 4,093,176 | 6/1978 | Contastin | 249/167 |
| 4,159,136 | 6/1979 | Kimball | 292/111 |
| 4,474,492 | 10/1984 | Fleitas | 292/304 |
| 4,643,331 | 2/1987 | May | 292/111 X |
| 4,882,655 | 11/1989 | Pavie | 361/391 |
| 4,948,181 | 8/1990 | Pritchard | 272/28 |

OTHER PUBLICATIONS

"Standard Handbook of Fastening & Joining" McGraw-Hill, 1977, pp. 10-29 to 10-32.

*Primary Examiner*—Richard E. Moore

*Attorney, Agent, or Firm*—R. Dennis Marchant; John R. Manning; Paul S. Clohan, Jr.

[57] ABSTRACT

A latching device for latching two items together has a housing and a shaft mounted to one item such that rotation of the shaft by a sprocket causes the shaft to move longitudinally up and down. The shaft has one end extending beyond the housing with a alignment cone attached to this end for engaging a receptor on the other item. A latch mounted to the shaft by a traveling nut provides a pivot point for the latch so that rotation of the shaft causes the pivot point of the latch to translate along the longitudinal axis of the shaft. Camming surfaces and a camming spring are used for rotating the latch so that the latch will engage and disengage a receptor on the other item.

14 Claims, 8 Drawing Sheets

J-HOOK LATCHING DEVICE

ORIGIN OF THE INVENTION

The invention described herein was made by an employee of the United States Government and may be manufactured and used by or for the Government for governmental purposes without the payment of any royalties thereon or therefore.

TECHNICAL FIELD

This invention relates to latch assemblies and more particularly to a latching device that will provide coarse and fine alignment to latch and secure items together such as Orbital Replacement Units, avionic boxes, satellite modules, doors, covers, and other varied cargos.

BACKGROUND ART

The prior art is replete with latching devices of various sorts. Examples are Acme screws, pawl and double pawl latches, claw latches, shear latches, and toggle or hook lock latches. While each of these has many unique and useful aspects, they all have disadvantages. For example, Acme screws have a high actuation torque for a reasonable pre-load and because they have a high torque and large thread pitch this makes them difficult to gang together. The threads on Acme screws are difficult to start and can be damaged during starting. Finally, the Acme screw is difficult to see to determine visual latch confirmation. Pawl latches (single and double) are not suitable for all applications because the latching mechanism is complex as rotation provides initial latching and pull down, and visual latch confirmation is difficult. Claw latches have a poor thrust to weight ratio, a poor strength to weight ratio, and the mechanism is complex because it contains ball screws, gears, etc. Shear latches are inadequate for some applications because they are difficult to mate as the tolerances are generally very close. Also, in order for the mechanism to mate, sufficient clearances must exist between the pin and hole and this clearance will allow the item being latched to move. Shear latches are also only two dimensional which limits their applications. Toggle or hook lock latches are often complex and generally not suitable for simultaneous actuation from one location.

STATEMENT OF THE INVENTION

It is therefore an object of the present invention to provide a latching mechanism that is extremely simple, with few parts and that will combine a high latching pre-load with a low actuation torque without the use of mating threads for capture and pull down. This will enable the use of a small drive system for the closure mechanism and/or the ability to actuate many latches from one location, thus accommodating various sizes and weights of items to be latched. This also reduces the complexity of the latching mechanism and lowers the likelihood of a failure.

Another object of the present invention is to provide a latching mechanism that has a superior strength to weight ratio and thrust to weight ratio, as compared to the prior art devices, and that will provide alignment and latching in one, two, or three dimensions.

A further object of the present invention is to provide a latch that not only provides a positive grip between the item to be latched to and the item to be latched, but utilizes the same mechanism for alignment and ejecting thus reducing the weight and complexity of the mechanism. The latching pre-load is also local to the latch and not transmitted through the structure of the item to be latched.

A still further object of the invention is to provide a latch that is exposed thus allowing a visual determination of the status of the mechanism.

The foregoing objects are achieved by a unique latching device that will "latch" or hold two items together. The item to be "latched to" can be an item such as a base platform, the deck of a ship, the flatbed of a trailer, etc. as long as a special receptor is provided. The J-Hook Latching Device is mounted by any standard method to an item to be "latched" by a mounting bracket which is also the housing for all of the various components of the J-Hook Latching Device. The special receptor, which is made a part of item to be "latched to", not only functions as one of the items to be "latched" together, but also provides alignment for the J-Hook Latching Device. The J-Hook Latching Device also has a shaft, a drive sprocket attached to the shaft, a J-Hook attached to a traveling nut in a manner that allows it to rotate, and an ejector/alignment cone which is designed to mate with the receptor.

The design of J-Hook Latching Device is such that the J-Hook will rotate inward and upward as the shaft is raised. The item to be "latched" is lowered to a point where the ejector/alignment cone is captured within the receptor. As the shaft is rotated clockwise by a drive sprocket, differential screw threads on the shaft rotate within a fixed nut and cause the shaft to rise. Located just above the differential screw threads are another set of screw threads, the travelling nut threads. These threads will cause a traveling nut to raise on the shaft as the shaft is turned. Because the traveling nut is prevented from turning by the housing, when the shaft is turned, the traveling nut will translate up the shaft; and because the J-Hook is pined to the traveling nut, it will also translate up the shaft at this point on the shaft. The J-Hook camming surface is held against a bracket camming surface by a latch camming spring, which is wound around a pin in the traveling nut and attached to the J-Hook. The latch camming spring will also provide rotation for the J-Hook as the shaft is raised, allowing the J-Hook to rotate under the receptor.

As the drive sprocket is driven in a clockwise motion (as seen from above), the shaft will continue to rise as the left handed differential screw threads turn within the fixed nut. Meanwhile, the traveling nut threads, which are right handed and have a pitch different than the differential screw threads, will cause the traveling nut to raise, allowing the latch camming spring to rotate the J-Hook under the receptor. The smooth portion of the shaft is allowed to rotate, move longitudinally, and remain in alignment by an alignment bushing located at the top of the housing.

As it is turned, the shaft will continue to rotate and rise bringing the two items to be "latched" together. The traveling nut will be raised by and also translate up the shaft to a point where the J-Hook is now parallel to the shaft and completely under the receptor. Further rotation of the shaft by the drive sprocket will cause the J-Hook to continue translation upward and allow the J-Hook to "capture" the receptor. The gap between the two items being "latched" is then decreased by the upward movement of the J-Hook until a predetermined amount of "pre-load" is placed on the J-Hook. The two items being "latched" are now securely held or "latched" together. To "unlatch" the items, one simply reverses the direction of rotation of the drive sprocket.

There is also a unique alternate method of operation of the present invention that is important for space applications. In this alternate method, known as "soft-dock", the J-hook is partially closed prior to the item to be "latched" being lowered to a point where the ejector/alignment cone is captured within the receptor of the item to be "latched to". As the ejector/alignment cone begins to capture the receptor, the J-hook is forced away from the receptor; when the ejector/alignment cone becomes seated in the receptor, the J-hook "snaps" back to its previous position, providing partial capture of the item to be "latched to". As before, further rotation of the shaft by the drive sprocket will cause the J-Hook to continue its translation upward and allow the J-Hook to fully "capture" the receptor. The gap between the two items being "latched" is then decreased by the upward movement of the J-Hook until a predetermined amount of "pre-load" is placed on the J-Hook. The two items being "latched" are now securely held or "latched" together. As stated, the "soft dock" method is desirable when a partial capture of the item to be "latch to" is necessary prior to complete capture, such as in space applications.

DETAILED DESCRIPTION OF THE INVENTION

Figure 1:
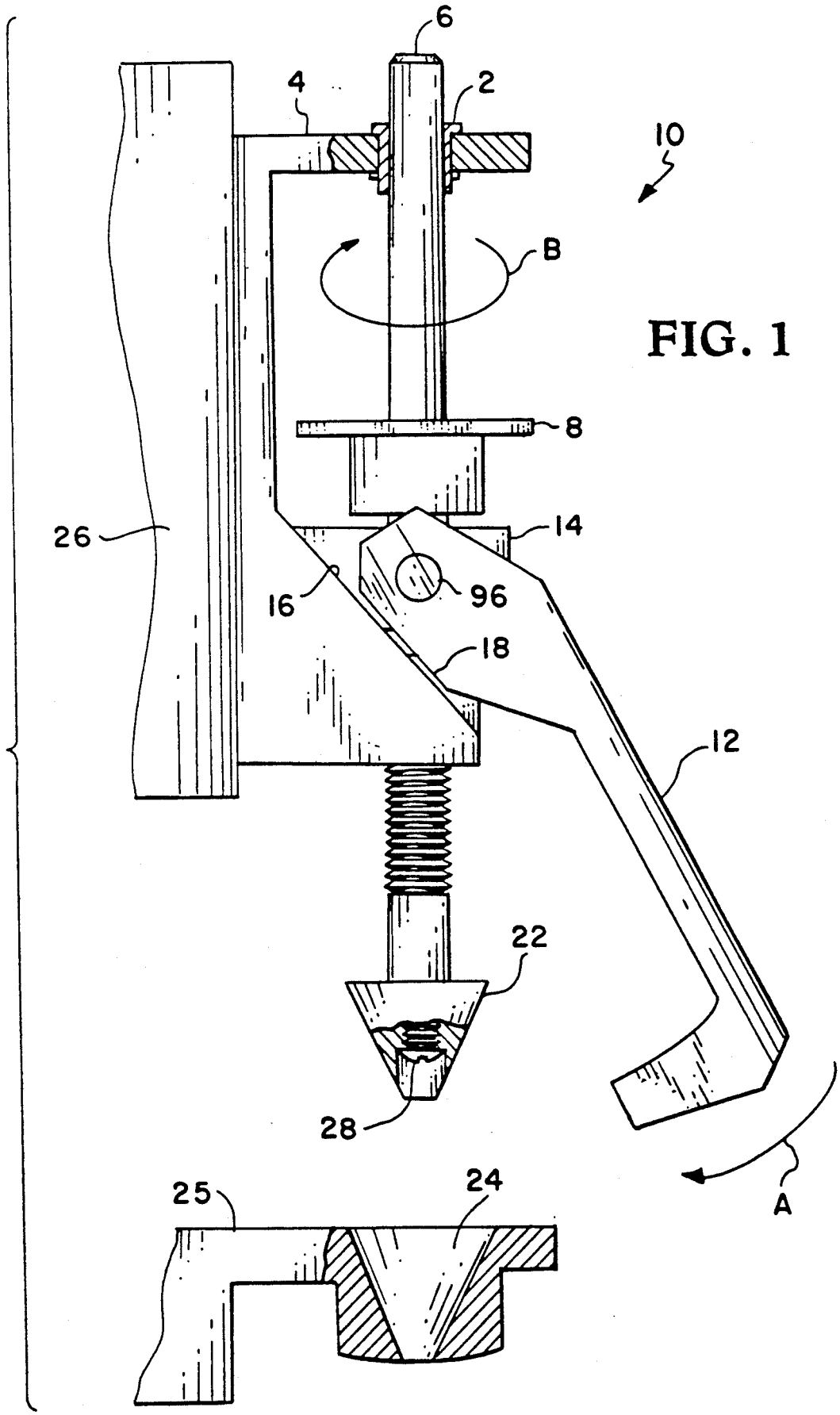
FIG. 1 is depiction of the J-Hook Latching Device attached to an item to be "latched" prior to engagement with the receptor located on the item to be "latched to".

Referring now to FIG. 1, a J-Hook Latching Device 10 is shown according to the present inventive concept. As is known and understood in prior art devices, a "latch" is generally used to "latch" or hold two items together. In this case, the two items to be "latched" together are an item to be "latched" 26 and an item to be "latched to" 25. Item to be "latched to" 25, which can be an item such as a base platform, the deck of a ship, the flatbed of a trailer, etc. must have an integral receptor 24 which will be more fully described later. The J-Hook latching device 10 is mounted by any standard method such as bolts, welding, etc. to item 26 by mounting bracket 4, which is also the housing for mounting all of the various components of J-Hook latching device 10 which will be described in detail below. Receptor 24, part of item 25, not only functions as one of the two items to be "latched" together, but also provides alignment for J-Hook latching device 10; this will be described in detail later. The J-Hook latching device 10 also has a shaft 6, alignment bushing 2, a drive sprocket 8, which is either welded or pined to shaft 6 (or can be made an integral part of shaft 6), a J-Hook 12, which is attached to traveling nut 14 in a manner that allows it to rotate about shaft 96, and an ejector/alignment cone 22, which is designed to mate with receptor 24.

Figure 1A:
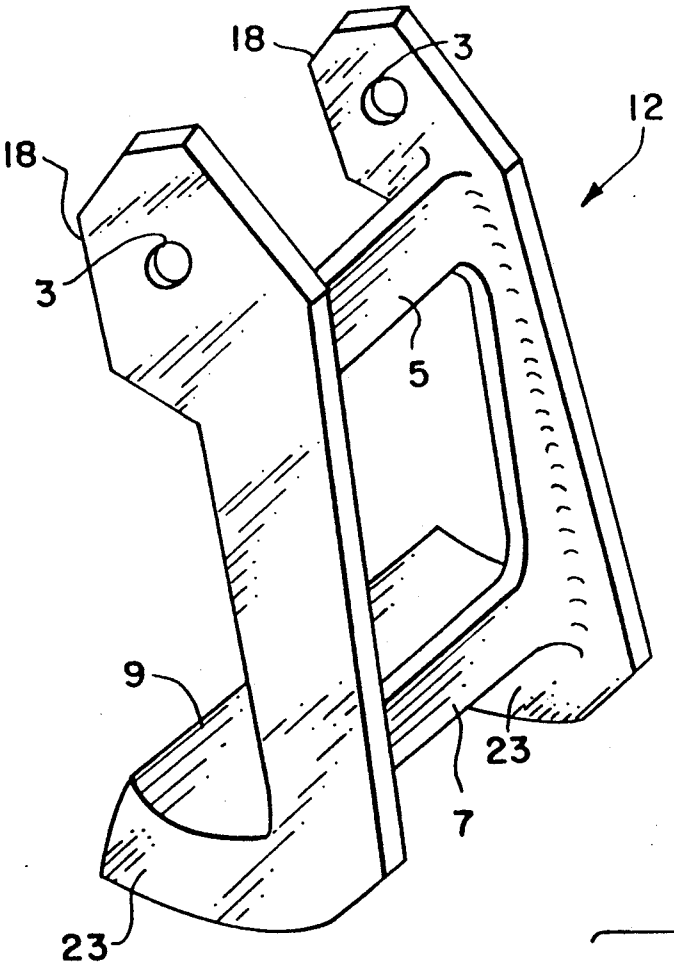
FIG. 1*a* is a perspective view of the J-Hook, item 12 in FIG. 1.

FIG. 1*a* shows a perspective view of J-Hook 12. J-Hook 12 is mounted on shaft 96 (which does not go through traveling nut 14 but is a split shaft, i.e., the shaft is on either side of traveling nut 14 but does not extend through traveling nut 14) through an aperture 3 on either side of J-Hook 12. J-Hook 12 has a left and right hook portion 23, a top flange 5 and a bottom flange 7 connecting the left and right portions of J-Hook 12, and a flat or "capture" area 9 between hook portions 23 which will "capture" receptor 24 as described below. Also shown is J-Hook camming surface 18 which mates with camming surface 16.

FIG. 1 shows the J-Hook Latching Device 10 with J-Hook 12 in the open or "cammed-out" position and the ejector/alignment cone 22 fully extended. The J-Hook Latching Device 10 would be in this configuration just prior to items 26 and 25 being brought together for "latching". Ejector/alignment cone 22 is poised just above receptor 24 (shown in partial cross-section) and J-Hook 12 is "cammed-out" so as to clear receptor 24 as item 26 is lowered toward item 25. J-Hook 12 is held in this position by camming surface 16, which has a predetermined slope that matches J-Hook camming surface 18. When shaft 6 is in its most downward position, with ejector/alignment cone 22 fully extended, as shown in FIG. 1, camming surface 16 will mate with J-Hook camming surface 18 and J-Hook 12 will be "cammed-out" as shown. The design of J-Hook Latching Device 10 will cause J-Hook 12 to rotate clockwise (see arrow A) and move upward as shaft 6 is rotated clockwise (see arrow B); the discussions accompanying FIGS. 2–5 will provide the detailed description of exactly how this is accomplished. Also shown in FIG. 1 is one of many methods of attachment of ejector/alignment cone 22 to shaft 6. Ejector/alignment cone 22 is attached to shaft 6 by a cone retaining screw 28, which allows ejector-/alignment cone 22 to be removed from shaft 6 for replacement, repair, or to change the size of ejector-/alignment cone 22. Various other methods of attachment are possible, such as welding, pinning, etc., and are well understood in the art and require no further discussion.

Figure 6:
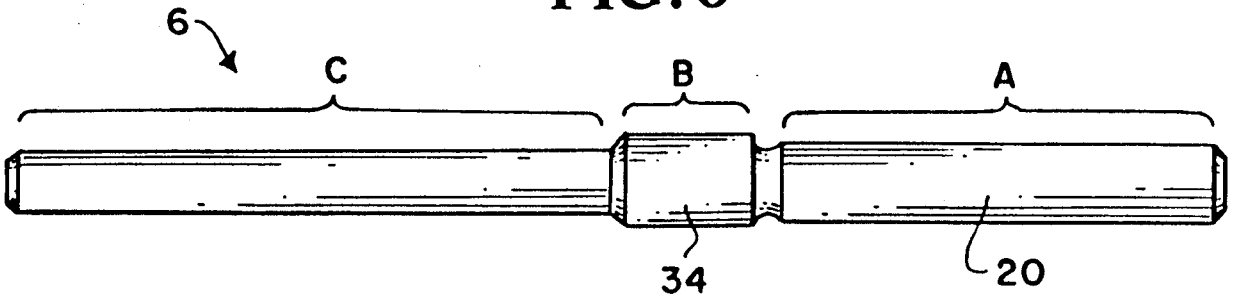
FIG. 6 is a view of the shaft of the J-Hook Latching Device.
Figure 2:
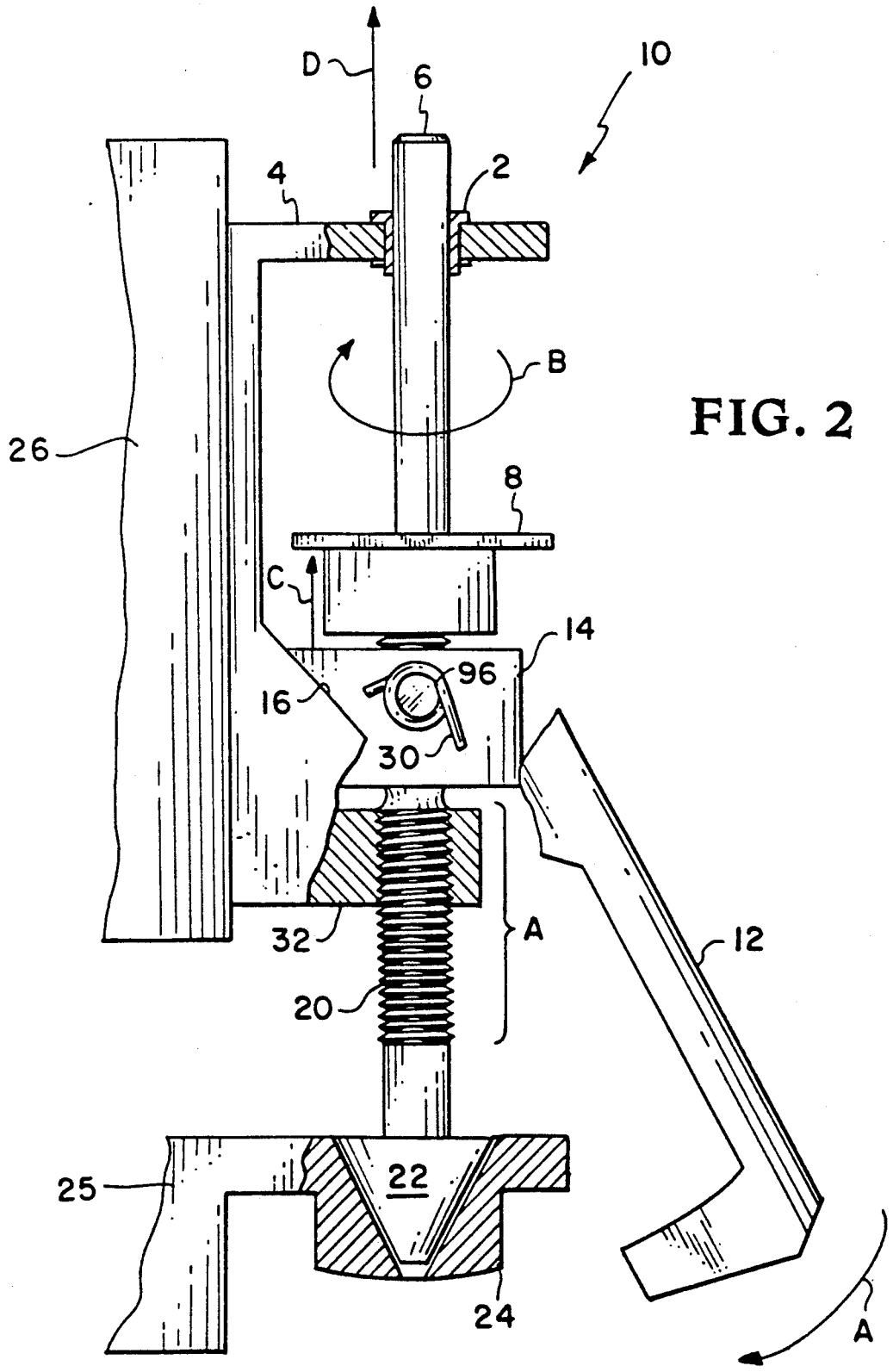
FIG. 2 is a depiction of the J-Hook Latching Device on initial engagement with the receptor.

As shown in figure 2, item 26 has now been lowered to a point where ejector/alignment cone 22 is now "captured" within receptor 24. Also now shown in FIG. 2 is the lower portion of shaft 6 as a part of J-Hook 12 has been cut-away. It can now be clearly seen that shaft 6 has a threaded area "A" on its lower end. These threads are "left-handed" differential screw threads 20, and are threaded within a fixed nut 32 which is actually a part of bracket 4. It can therefore be seen that as shaft 6 is rotated clockwise (arrow B) by drive sprocket 8, differential screw threads 20 rotating within fixed nut 32, will cause shaft 6 to rise (arrow D) and, consequently, bracket 4 with attached item 26 to lower toward item 25. Located just above differential screw threads 20 on shaft 6 are a second set of threads, the "travelling nut 14" threads (item 34 in FIGS. 5 and 6). These are the threads that contain traveling nut 14 and allow it to also rise (arrow C) as shaft 6 is turned clockwise (arrow B). Traveling nut 14 is prevented from turning by bracket 4, thus when shaft 6 is turned clockwise, traveling nut 14 will translate up the longitudinal axis of shaft 6 (see arrow C). Because J-Hook 12 is attached by shaft 96 to traveling nut 14, it will also translate up at this point on shaft 6. The configuration of shaft 6 can be seen more clearly in FIG. 6, where area "A" contains the differential threads 20, area "B" contains the travelling nut threads 34, and area "C" is a smooth portion where drive sprocket 8 is mounted.

Referring back now to FIG. 2, ejector/alignment cone 22 is now captured within receptor 24, J-Hook 12 is in the "cammed-out" position (fully extended), and shaft 6 is at the lowest position possible. J-Hook camming surface 18 (shown in FIG. 1) is held against camming surface 16 by latch camming spring 30, which is wound around shaft 96 and attached to J-Hook 12 in a standard manner at one end and travelling nut 14 at the other end. Latch camming spring 30 will also provide rotational energy for J-Hook 12 as shaft 6 is raised, allowing J-Hook 12 to rotate under receptor 24 (see arrow A); this will be shown in detail later. Thus items 25 and 26 have now been brought close together, and are ready to be "latched" together by J-Hook Latching Device 10.

Figure 3:
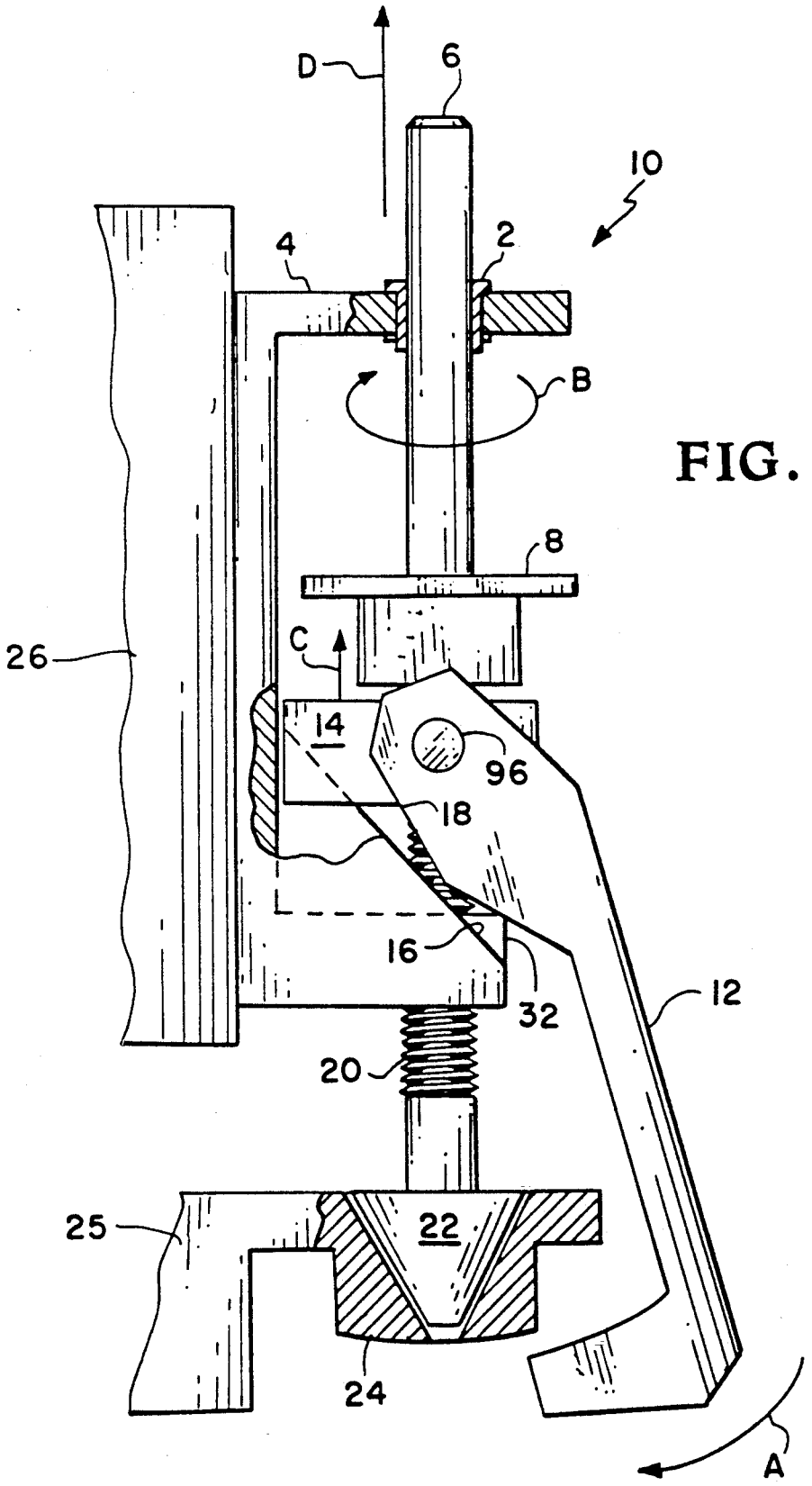
FIG. 3 a depiction of the J-Hook Latching Device in the receptor with the J-Hook beginning to capture the receptor.

In FIG. 3, shaft 6 continues to be rotated clockwise by drive sprocket 8 (arrow B). Sprocket 8 is a standard sprocket and can be gear driven, chain driven, etc. Due to the left-handed threads on differential screw threads 20, as sprocket 8 is driven in a clockwise motion (arrow B), shaft 6 will rise (arrow D) as differential screw threads 20 turn within fixed nut 32. Meanwhile, the traveling nut threads 34 ( shown in FIG. 6), which are right-handed and have a slightly different pitch than the differential screw threads, are causing traveling nut 14 to also rise (arrow C), thus allowing latch camming spring 30 (shown in FIG. 2) to rotate (arrow A) J-Hook 12 under receptor 24 within the constraints of camming surfaces 16 and 18. Travelling nut 14 thus translates upwards (arrow C) due in part to the upwards motion of shaft 6 (arrow D) and in part to the upwards translation of the travelling nut itself caused by its travelling nut threads 34 (shown in FIG. 6). The smooth portion of shaft 6 is simultaneously allowed to rotate (arrow B) and move longitudinally upward (arrow D) by alignment bushing 2 located at the top cf mounting bracket 4.

Figure 4:
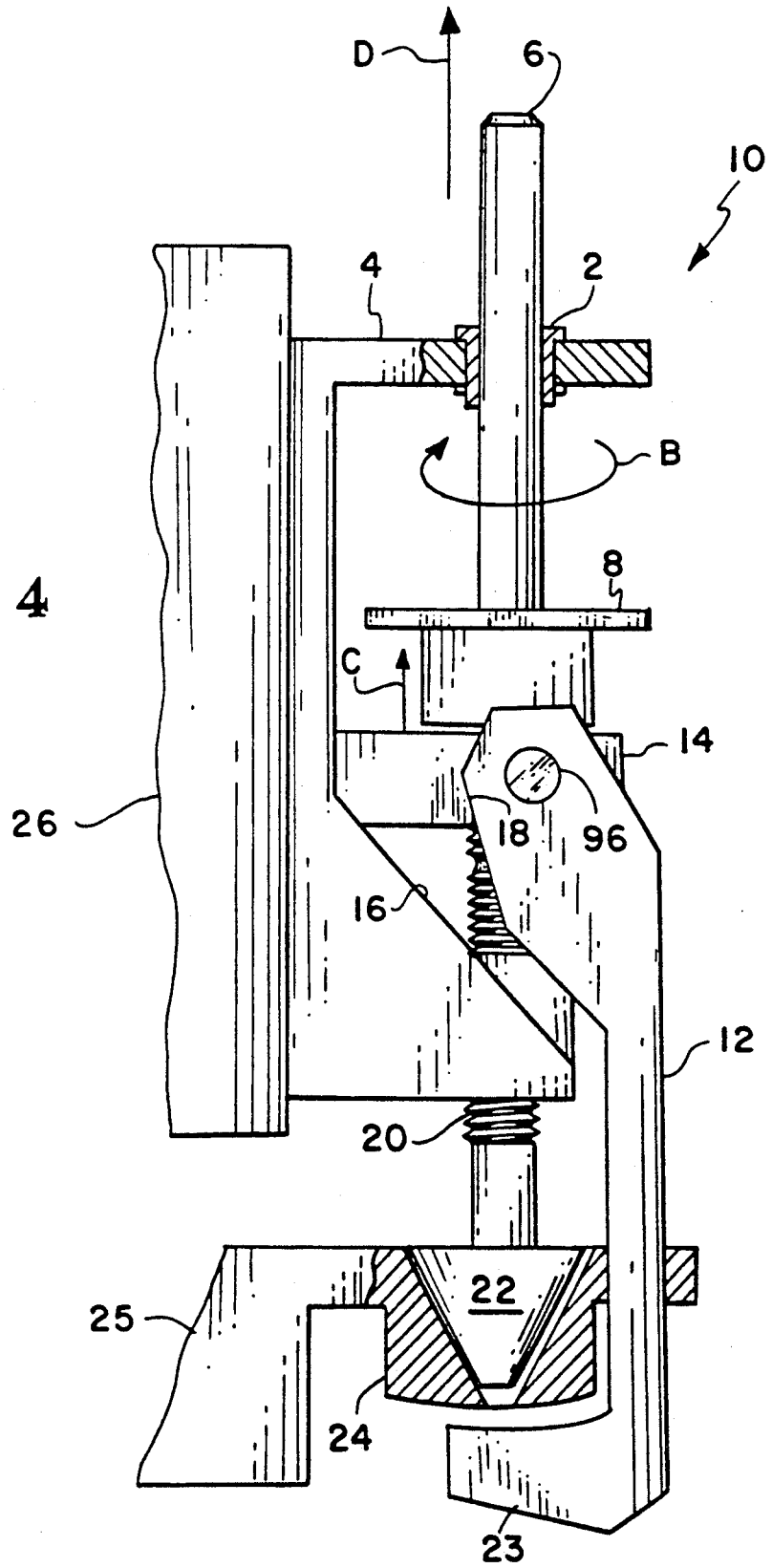
FIG. 4 is a depiction of the J-Hook Latching Device in the receptor with the J-Hook fully rotated under the receptor.
Figure 5:
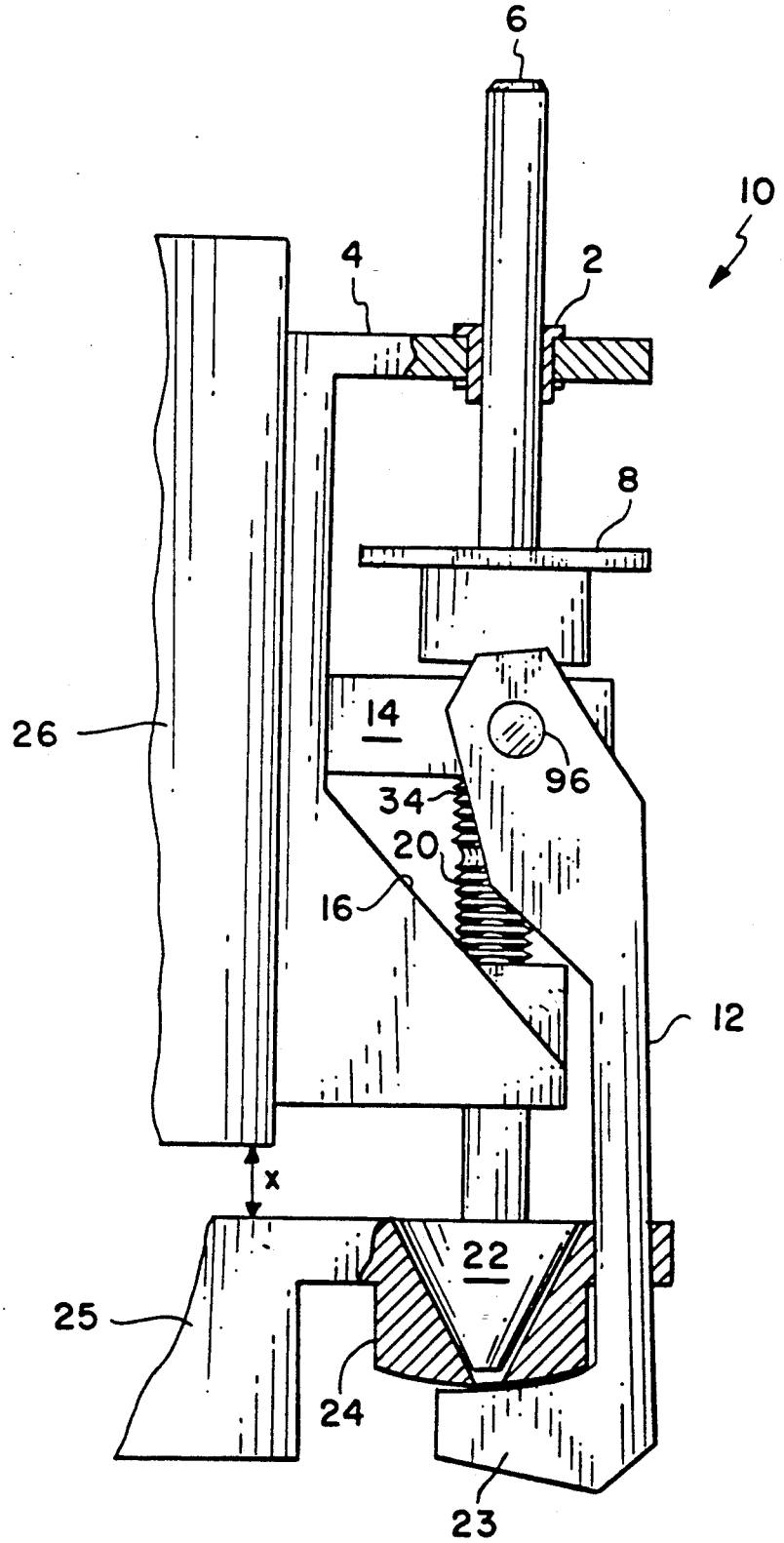
FIG. 5 is a depiction of the J-Hook Latching Device in the receptor with the J-Hook fully engaged with the receptor and including a pre-load.

In FIG. 4, shaft 6 has continued to rotate and rise bringing items 25 and 26 still closer together. Traveling nut 14 has now translated up shaft 6 to a point where the longitudinal axis of J-Hook 12 is now parallel to the longitudinal axis of shaft 6 and its hook portion 23 is now completely under receptor 24. Further rotation of shaft 6 by sprocket 8 will now cause J-Hook 12 to continue its translation upward and allow hook portion 23 of J-Hook 12 to "capture" receptor 24. This is depicted in FIG. 5, where the "gap" "x" between items 25 and 26 has been decreased by the upward movement of shaft 6 until a predetermined "pre-load" is placed on J-Hook latching device 10. Items 25 and 26 are now securely held or "latched" together. To "unlatch" items 25 and 26, one simply reverses the direction of rotation of drive sprocket 8.

ALTERNATE EMBODIMENTS

Figure 7:
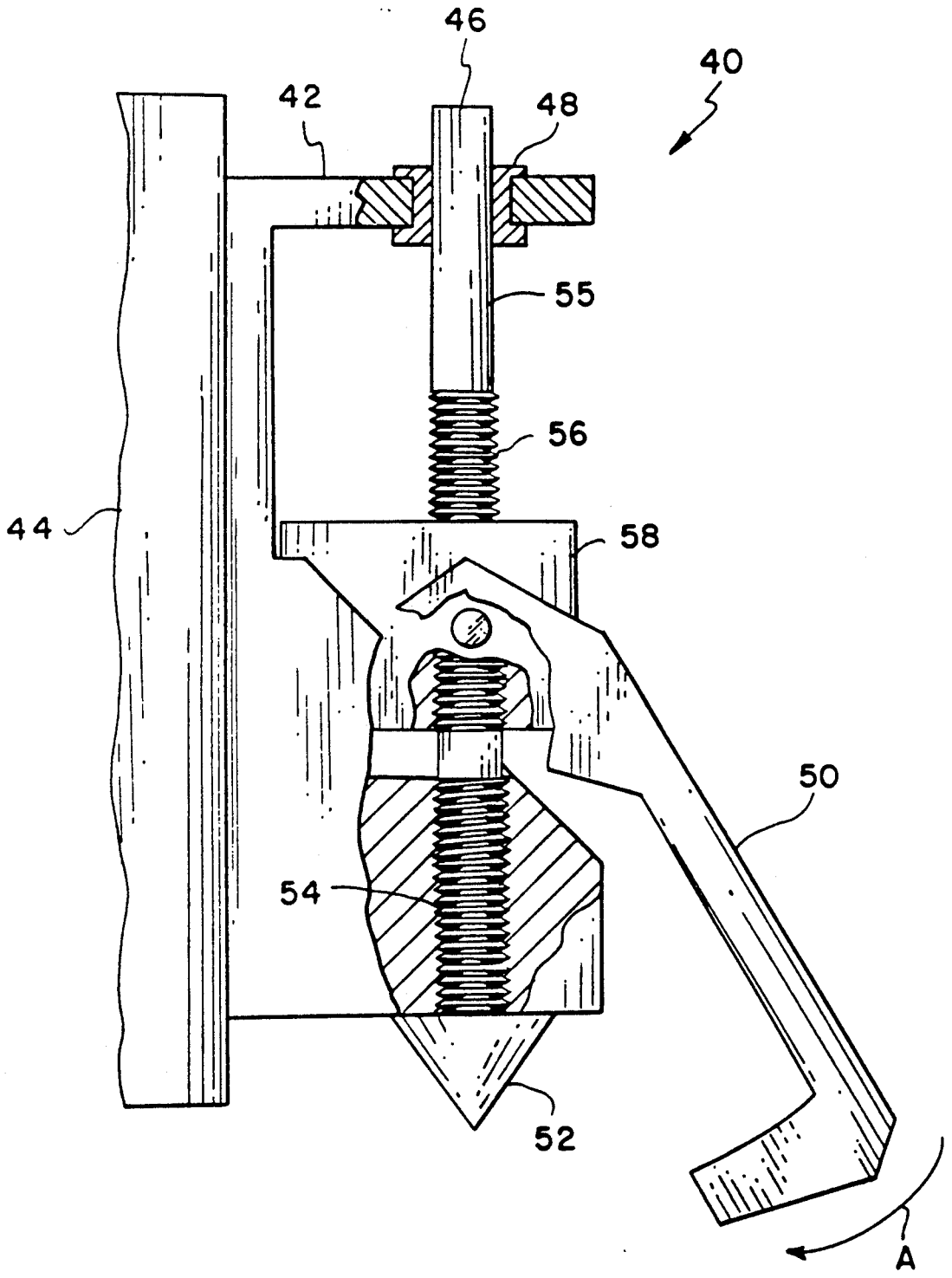
FIG. 7 is a depiction of a first alternate embodiment of the J-Hook Latching Device.

Shown in FIG. 7 is a first alternate embodiment 40 of a J-Hook latching device according to the present inventive concept (the receptor is not shown as it is identical to the preferred embodiment). In this embodiment, as in the preferred embodiment, J-Hook latching device 40 has a mounting bracket 42, mounted on an item to be "latched" 44, and a shaft 46 held by alignment bushing 48. Shaft 46 has differential screw threads 54, traveling nut threads 56, and a smooth portion 55. Although not shown, shaft 46 can be turned with a sprocket, as in the preferred embodiment, or by any other desired means. As in the preferred embodiment, turning shaft 46 clockwise causes left-handed differential screw threads 54 to raise shaft 46 and right-handed traveling nut threads 56 to raise traveling nut 58 thereby raising and rotating attached J-Hook 50 as in the preferred embodiment. Note that in this embodiment, the ejector/alignment cone 52 is an integral part of mounting bracket 42 rather than affixed to shaft 46.

Figure 8:
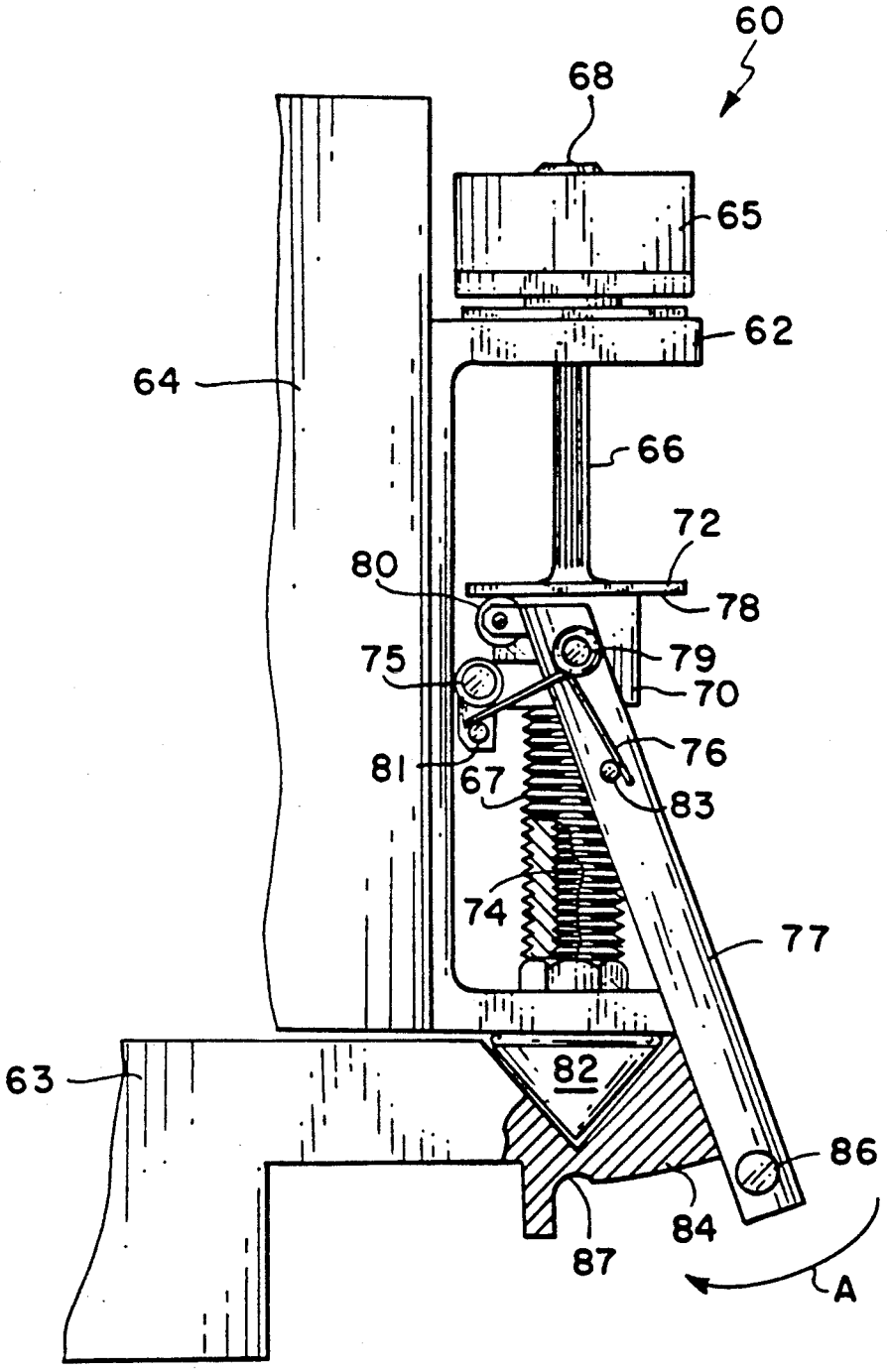
FIG. 8 is a depiction of a second alternate embodiment of the J-Hook Latching Device.

Shown in FIG. 8 is a second alternate embodiment 60 of the J-Hook latching device. In this embodiment, as in the preferred embodiment, J-Hook latching device 60 has a mounting bracket 62 affixed to an item to be "latched" 64. Receptor 84 is affixed to item to be "latched to" 63. J-Hook latching device 60 has a shaft 68 which has a splined portion 66 that mates with and is turned by a standard bi-directional rolling element clutch 65 well known in the prior art. As in the first alternate embodiment shown in FIG. 7, alignment cone 82 is an integral part of bracket 62. The longitudinal movement of shaft 68 is provided by differential screw threads 67 which on their external surface mate with traveling nut 70 and on their internal surface mate with fixed screw threads 74. Traveling nut 70 is prevented from turning by roller 75 which rolls up and down bracket 62. The J-Hook of the preferred embodiment and first alternate embodiment has been replaced by a "stirrup" 77. Stirrup 77 functions much like the J-Hook except that instead of having a hooked portion on its end it has a stirrup shaft 86. The camming action of stirrup 77 is provided by camming roller 80 which rolls along camming surface 78 of flange 72 which is a part of shaft 68. Return spring 76, which is wound around pivot shaft 79 and secured by pins 81 and 83, rotates stirrup 77 (see arrow A) so that stirrup pin 86 captures receptor 84 by engaging groove 87 on receptor 84.

In all three of the disclosed embodiments of the J-Hook latching device, simplicity of design yields a device that will tolerate component failure. Therefore, if the drive mechanism to the shaft fails, the latching device can still be operated manually by turning the shaft (and therefore the differential screw threads) directly. Also, if any of the threads become jammed or locked, the J-Hook (or stirrup) can by pried loose from the receptor to separate the two latched items.

In all three of the disclosed embodiments of the J-Hook latching device, a custom shaped mounting bracket can be provided for different applications. The ejector/alignment cones can be of various geometries for varied applications. The J-Hook (or stirrup) can also be of different geometries as long as it can cam in and out for capture and release. The differential screw threads can be any practical diameter and the thread pitch can be varied for various hook-receptor closure rates. Various screw threads or screw devices can be used for the differential threads, e.g., Acme screws, V-threads, roller screws, ball screws, etc. The means for turning the shaft could have a clutch or reduction mechanism. J-Hook latching devices can be ganged together and/or more than one can be operated at a time. The ejector/alignment cones and the receptors can be changed for one, two, or three dimensional latching applications. The J-Hook (or stirrup) and receptor geometry can be changed slightly until the J-Hooks (or stirrups) will spring out and capture enough to retain the item to be latched while the differential screw thread is being rotated.

There is also a unique alternate method of operation of the present invention that is important for space applications. Refer back to FIGS. 1-5 for the following discussion. In this alternate method, known as "soft-dock", J-hook 12 is partially closed prior to item to be "latched" 26 being lowered to a point where ejector-/alignment cone 22 is captured within receptor 24 of item to be "latched to" 25. As ejector/alignment cone 22 begins to capture receptor 24, J-hook 12 is forced away (opposite direction of arrow A) from receptor 24; when ejector/alignment cone 22 becomes seated in receptor 24, J-hook 12 "snaps" back to its previous position, providing partial capture of item to be "latched to" 25. As before, further rotation of shaft 6 by drive sprocket 8 will cause J-Hook 12 to continue its translation upward and allow J-Hook 12 to now "fully capture" receptor 24. The gap between the two items being "latched" is then decreased by the upward movement of J-Hook 12 until a predetermined amount of "pre-load" is placed on J-Hook 12. The two items being "latched" are now securely held or "latched" together. As stated, the "soft dock" method is desirable when a partial capture of item to be "latch to" 25 is necessary prior to complete capture, such as in space applications.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A latching device for latching a first and second item together comprising:

a housing affixed to said first item having a shaft mounted thereon such that rotation of said shaft causes said shaft to move longitudinally;

said shaft having at least one end extending beyond said housing and having a first alignment means attached to this end for engaging a second alignment means on said second item;

a latch mounted to said shaft by a mounting means providing a pivot point for said latch such that rotation of said shaft causes said pivot point of said latch to translate along the longitudinal axis of said shaft; and means for rotating said latch such that said latch will engage said second alignment means on said second item thereby latching said first and second items together.

2. The device of claim 1 wherein the rotation of said shaft is provided by a drive sprocket affixed to said shaft.

3. The device of claim wherein said first alignment means comprises an object having a conical shape.

4. The device of claim 1 wherein said latch comprises a J-hook having a left and right hook portion with a capture area therebetween.

5. The device of claim 1 wherein said mounting means providing a pivot point for said latch such that rotation of said shaft causes said pivot point of said latch to translate along the longitudinal axis of said shaft comprises a nut having a split shaft for mounting said latch threaded to said shaft, said nut prevented from turning by said housing.

6. The device of claim 1 wherein said means for rotating said latch such that said latch will engage said second alignment means on said second item comprises a camming surface on said housing mating with a camming surface on said latch and a spring for providing rotational energy to said latch.

7. A latching device for latching a first and second item together comprising:

a housing affixed to said first item having a shaft mounted thereon such that rotation of said shaft causes said shaft to move longitudinally;

said housing having a first alignment means attached to one end for engaging a second alignment means on said second item;

a latch mounted to said shaft by a mounting means providing a pivot point for said latch such that rotation of said shaft causes said pivot point of said latch to translate along the longitudinal axis of said shaft; and means for rotating said latch such that said latch will engage said second alignment means on said second item thereby latching said first and second items together.

8. The device of claim 7 wherein the rotation of said shaft is provided by a bi-directional rolling element clutch affixed to a splined portion said shaft.

9. The device of claim 7 wherein said first alignment means comprises an object having a conical shape.

10. The device of claim 7 wherein said latch comprises a j-hook having a left and right hook portion with a capture area therebetween.

11. The device of claim 7 wherein said latch comprises a stirrup.

12. The device of claim 7 wherein said mounting means providing a pivot point for said latch such that rotation of said shaft causes said pivot point of said latch to translate along the longitudinal axis of said shaft comprises a nut having a split shaft for mounting said latch threaded to said shaft, said nut prevented from turning by said housing.

13. The device of claim 7 wherein said means for rotating said latch such that said latch will engage said second alignment means on said second item comprises a camming surface on said housing mating with a camming surface on said latch and a spring for providing rotational energy to said latch.

14. The device of claim 11 wherein said means for rotating said latch such that said latch will engage said second alignment means on said second item comprises a camming surface on a flange on said shaft mating with a camming roller affixed to said stirrup and a spring for providing rotational energy to said stirrup.

* * * * *